US008950341B2

(12) United States Patent
Boring et al.

(10) Patent No.: US 8,950,341 B2
(45) Date of Patent: Feb. 10, 2015

(54) MULTI-UNIT INTERMODAL RAILROAD WELL CAR WITH SAFETY PLATFORM AND HANDBRAKE

(71) Applicants: Jeff Boring, New Florence, PA (US); Dave Lohr, Storystown, PA (US); Greg P. Josephson, Salix, PA (US); Christopher S. Wissinger, New Paris, PA (US)

(72) Inventors: Jeff Boring, New Florence, PA (US); Dave Lohr, Storystown, PA (US); Greg P. Josephson, Salix, PA (US); Christopher S. Wissinger, New Paris, PA (US)

(73) Assignee: Jac Operations, Inc., Chicago, IL (US)

( * ) Notice: Subject to any disclaimer, the term of this patent is extended or adjusted under 35 U.S.C. 154(b) by 68 days.

(21) Appl. No.: 13/624,872

(22) Filed: Sep. 21, 2012

(65) Prior Publication Data

US 2013/0255533 A1 Oct. 3, 2013

Related U.S. Application Data

(60) Provisional application No. 61/537,556, filed on Sep. 21, 2011.

(51) Int. Cl.
*B61D 3/20* (2006.01)
*B61D 3/12* (2006.01)

(52) U.S. Cl.
CPC ... *B61D 3/20* (2013.01); *B61D 3/12* (2013.01)
USPC ..... 105/355

(58) Field of Classification Search
USPC ..... 105/404, 355, 421, 410, 418, 436; 188/33, 34, 52
See application file for complete search history.

(56) References Cited

U.S. PATENT DOCUMENTS

| | | | | |
|---|---|---|---|---|
| 4,420,065 | A * | 12/1983 | Bayliss | 188/56 |
| 4,771,706 | A | 9/1988 | Lindauer et al. | |
| 4,909,157 | A | 3/1990 | Jamrozy et al. | |
| 4,949,646 | A | 8/1990 | Jamrozy et al. | |
| 5,017,066 | A | 5/1991 | Tylisz et al. | |
| 5,085,152 | A | 2/1992 | Tylisz et al. | |
| 5,170,718 | A | 12/1992 | Hill et al. | |
| 5,279,230 | A | 1/1994 | Thomas et al. | |
| 5,423,269 | A | 6/1995 | Saxton et al. | |
| 5,465,670 | A | 11/1995 | Butcher | |
| 5,730,063 | A * | 3/1998 | Forbes et al. | 105/355 |
| 6,003,445 | A | 12/1999 | Coslovi et al. | |
| 6,196,137 | B1 | 3/2001 | Forbes | |
| 6,505,564 | B2 | 1/2003 | Khattab | |
| 6,584,912 | B2 | 7/2003 | Forbes | |
| 6,877,266 | B1 | 4/2005 | Brownlee | |
| 7,954,437 | B2 | 6/2011 | Miller | |
| 2001/0010198 | A1 | 8/2001 | Forbes | |
| 2002/0173889 | A1 | 11/2002 | Odinak et al. | |
| 2002/0174799 | A1 | 11/2002 | Khattab | |

* cited by examiner

*Primary Examiner* — Mark Le
(74) *Attorney, Agent, or Firm* — Blynn L. Shideler; Krisanne Shideler; BLK Law Group

(57) ABSTRACT

A railroad well car includes a spaced trucks grouped in pairs, and a railcar body supported on a pair of the trucks, the body comprising a pair of spaced end structures, each end structure supported on one truck, and a well structure extending between the end structures. The well structure comprises a pair of top chord members extending between the end structures; a pair of side sills extending between the end structures. The rail car includes safety platform and handbrake wherein operator walkway platforms are included with co-planer end walkways and running boards, wherein the running boards are above the top chords of the sidewalls of the well car; and a handbrake operated with a hand wheel is mounted on one side of the railroad well car, which hand wheel extends below the top chords of the side walls of the well car whereby the hand wheel is accessible from the side of the railcar via an operator on the ground.

10 Claims, 3 Drawing Sheets

MULTI-UNIT INTERMODAL RAILROAD WELL CAR WITH SAFETY PLATFORM AND HANDBRAKE

RELATED APPLICATION

The present application claims the benefit of U.S. Provisional Patent Application Ser. No. 61/537,556 entitled "Multi-Unit Intermodal Railroad Well Car with Safety Platform and Handbrake" filed Sep. 21, 2011.

BACKGROUND OF THE INVENTION

1. Field of the Invention

The present invention relates to a multi-unit intermodal railroad well car, and more particularly to a well construction for a double stack container well car having a safety platform and a safety handbrake.

2. Background Information

Intermodal freight transport involves the transportation of freight in an intermodal container or vehicle, using multiple modes of transportation (such as rail, ship and truck), generally without any handling of the freight itself when changing modes. The method reduces cargo handling, and so improves security, reduces damages and losses, and allows freight to be transported faster. Reduced costs in over the road trucking is a key benefit for intra-continental use of intermodal freight transport.

The transportation of intermodal containers on railcars has been a common practice for several decades. The sizes and capacities of the containers have increased in time, and the Intermodal cargo containers (also called intermodal box containers or IBC) have now been standardized in various lengths such as, most commonly, 20, 40, and 53 feet. Intermodal cargo containers have also been standardized in width as well. In North America, intermodal containers are often shipped by rail in container well cars. These cars resemble flatcars but generally have a body 10 with a container-sized depression, or well, in the middle between the bogies or trucks 8 of the well car. This depression typically allows for sufficient clearance to allow two containers to be loaded in the car in a "double stack" arrangement. The newer container cars also are specifically built as a small articulated "unit", most commonly in combinations of three or five, whereby two car bodies 10 are connected by a single bogie 8 as opposed to two bogies, one on each car. On some railways, particularly in the United Kingdom, the use of well cars is limited to carrying a single stacked large container.

The body of the well car is generally at a low height, with containers in the bottom tier of a double-stacked container arrangement being supported approximately 10 inches above rail in a loaded car. The side wall structures of such well cars are generally formed as a plurality of internal or external side stakes and side sheets extending between the top chord and the side sill forming a substantially closed side wall structure.

U.S. Pat. No. 7,954,437, which is incorporated herein by reference, provides some additional well car background while describing a lightweight truss design for the body 10 as shown in FIG. 1 which eliminates the side sheets using an open truss arrangement. U.S. Patent Application Publication Nos. 2002/0174799, 2002/0173889 and 2001/0010198, and U.S. Pat. Nos. 6,877,266, 6,584,912, 6,505,564, 6,196,137, 6,003,445, 5,730,063, 5,465,670, 5,423,269, 5,279,230, 5,170,718, 5,085,152, 5,017,066, 4,949,646, 4,909,157 and 4,771,706, which are incorporated herein by reference, all disclose known well car arrangements.

It is common to place user walkways or platforms at the ends of the railcars and along at least a part of the length of the top of the sidewalls at the ends thereof to assist the rail operators gaining access to the car and cargo. Rail operators typically must access both ends of the car when working with a double stacked container arrangement. The platforms are of a width that accommodates a standing or walking user and are formed of a material suited to form a walkway. Ladders commonly are provided to allow easier access to the ends of the railcar and to these platforms or walkways when provided. Although the provision of platforms or walkways for the users does improve user access, the nature of well car construction has resulted in multiple levels for platforms with steps, often of uneven sizes, between the levels. The existing platforms create some difficulty and hazards for the users to navigate, although certainly easier than without any platforms at all.

Additionally a handbrake is often provided on the well cars, and it is typically provided in the middle of the end of the car such that the operators need to board the car to access and operate the handbrake.

There remains a need for improved safety in the walking platform and handbrake design in intermodal railroad well cars.

SUMMARY OF THE INVENTION

The present invention addresses the deficiencies of the prior art in part by providing a well car for multi unit configurations, particularly a double stack container well car for 20 and 40 foot containers, having operator walkway platforms with co-planer end walkways and running boards, wherein the running boards are above the top chords of the sidewalls of the well car.

The present invention addresses the deficiencies of the prior art in part by providing a well car for multi unit configurations, particularly a double stack container well car for 20 and 40 foot containers, having a handbrake operated with a hand wheel mounted on one side of the railcar, which hand wheel extends below the top chords of the side walls of the well car whereby the hand wheel is accessible from the side of the railcar via an operator on the ground.

One embodiment of the present invention provides a container well car comprising a pair of spaced trucks, and a railcar body supported on the trucks, the body comprising a pair of spaced end structures, each end structure supported on one truck, and a well structure extending between the end structures. The well structure comprises a pair of top chord members extending between the end structures and a pair of side sills extending between the end structures; and further including operator walkway platforms with co-planer end walkways and running boards, wherein the running boards are above the top chord of the sidewall of the well car These and other advantages of the present invention will be clarified in the brief description of the preferred embodiment taken together with the drawings in which like reference numerals represent like elements throughout.

DESCRIPTION OF THE PREFERRED EMBODIMENTS

Figure 1:
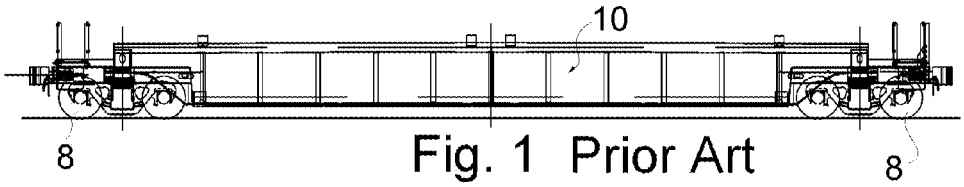
Fig. 1 Prior Art
FIG. 1 is a side elevation view of a prior art container well car.
Figure 2:
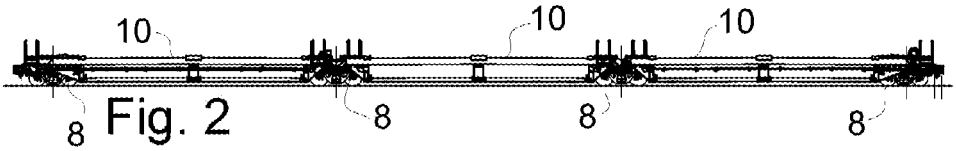
FIG. 2 is a side elevation view three unit intermodal railroad well car, having a safety platform and a safety handbrake according to one aspect of the present invention.
Figure 3:
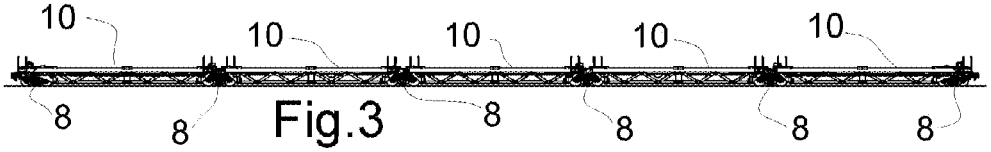
FIG. 3 is a side elevation view five unit intermodal railroad well car, having a safety platform and a safety handbrake according to one aspect of the present invention.
Figure 8:
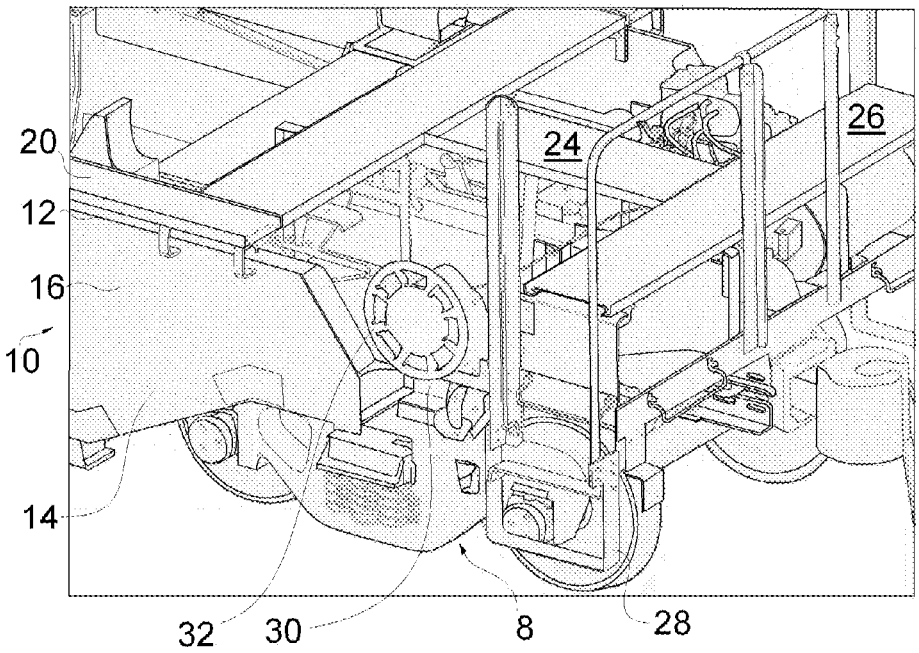
FIG. 8 is a perspective view of one end of the railcar body illustrating a safety handbrake according FIG. 6.
Figure 4:
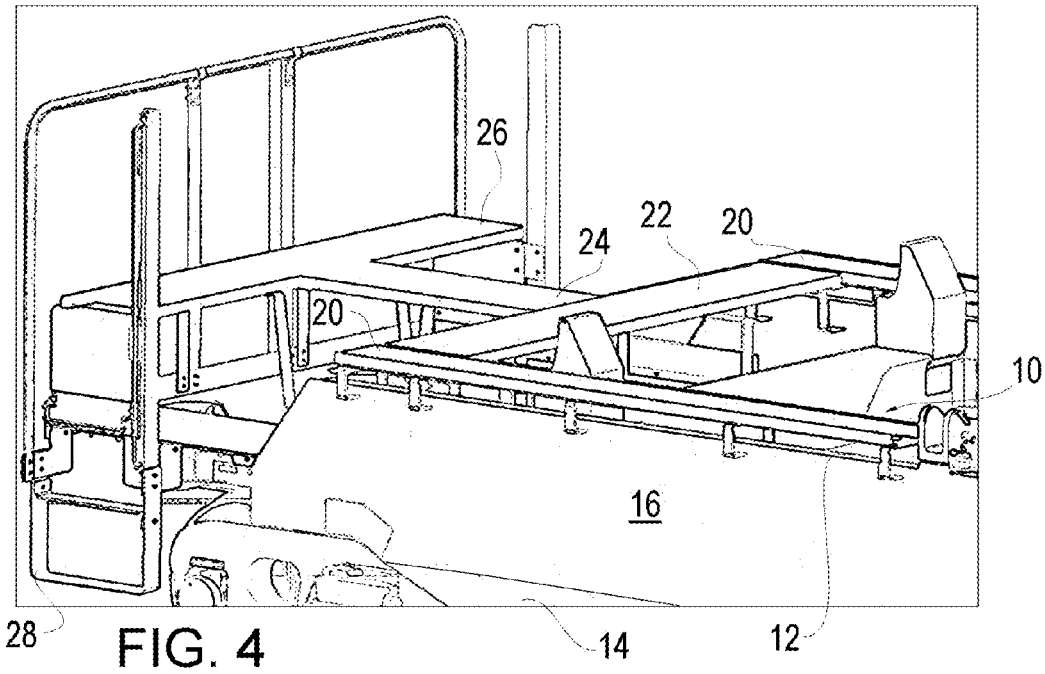
FIG. 4 is a perspective view a safety platform of one end of the railcar body according to one aspect of the present invention.
Figure 5:
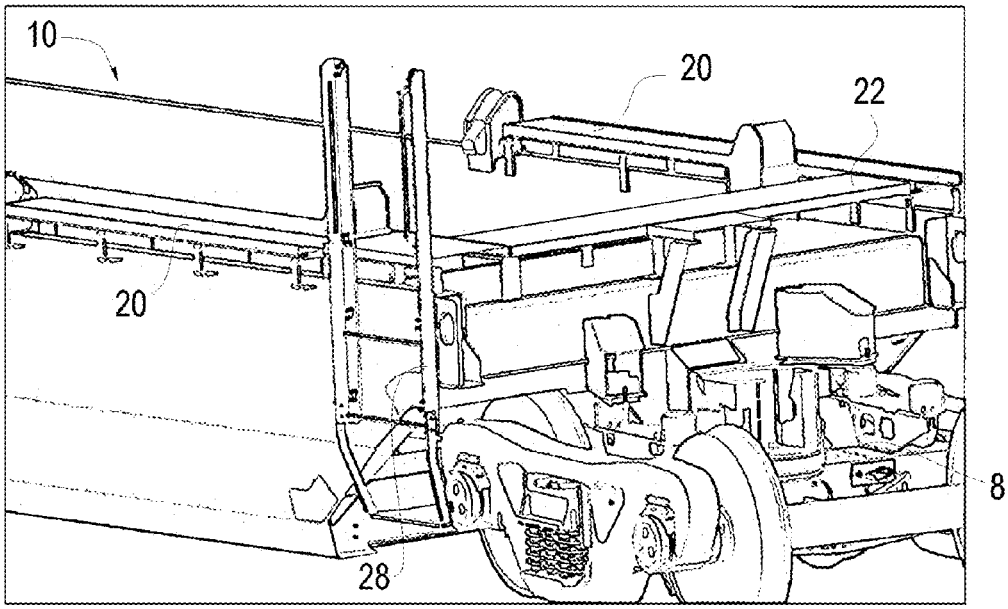
FIG. 5 is a perspective view a safety platform of one articulating end of the railcar body according to one aspect of the present invention.
Figure 6:
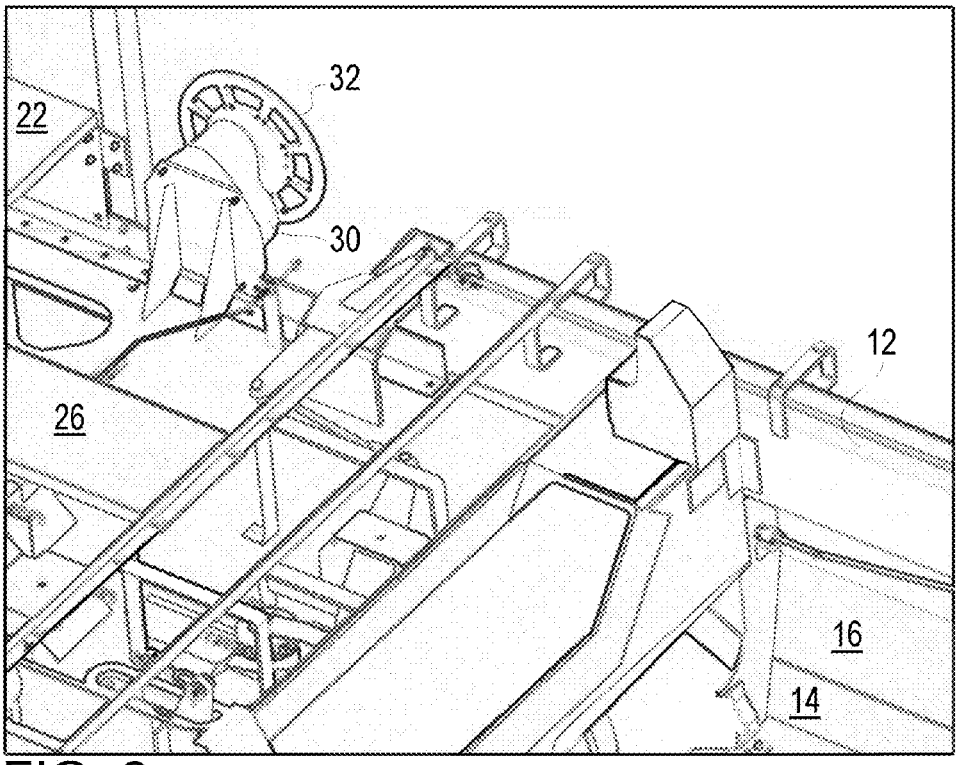
FIG. 6 is a perspective view of one end of the railcar body with portions of the safety platform removed to illustrate a safety handbrake according to one aspect of the present invention.
Figure 7:
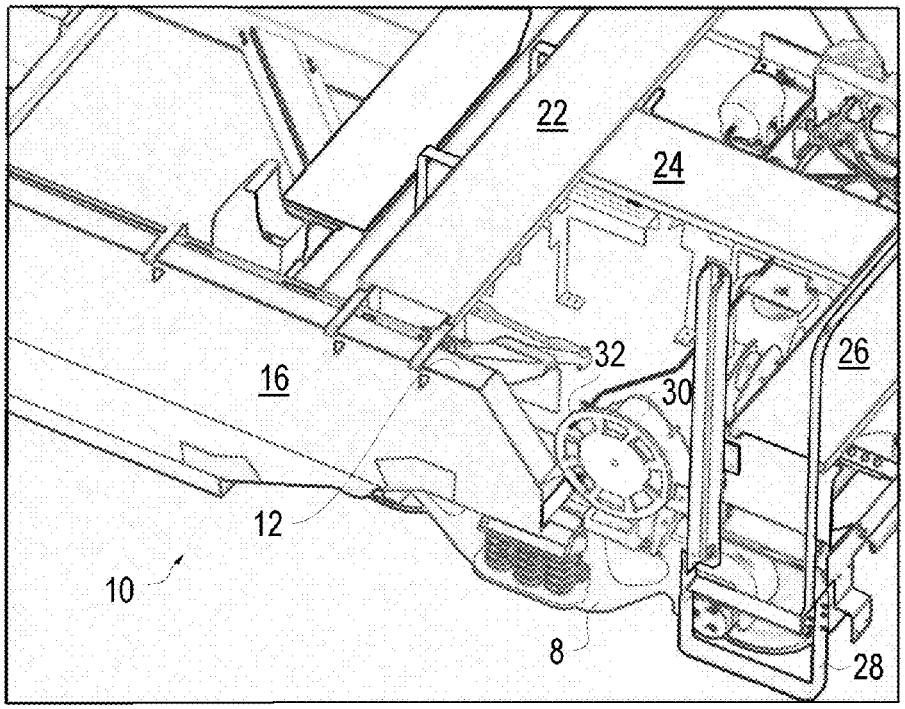
FIG. 7 is a perspective view of one end of the railcar body illustrating a safety handbrake according FIG. 6.

The present invention provides a double stack container well car for 20 and 40 foot containers. Three unit and five unit car assemblies of the invention are shown in FIGS. 2 and 3 but the present design can be implemented into a railcar have any desired number of units or bodies 10. The container well car according to the present invention comprises a conventional pair of spaced trucks 8 associated with each railcar body 10 supported on the trucks 8. The design of the trucks 8 is known in the art and not further detailed in this disclosure. As known in the art, on the articulating end of multi-unit bodies 10, a pair of adjacent bodies 10 share a common truck 8, while the distal end trucks 8 are associated with only one body 10.

Each body 10 comprises a pair of spaced end structures with each end structure supported on one truck 8, and a well structure extending between the end structures. The end structures will be formed in a generally conventional fashion to accommodate the appropriate loading and forces on the rail car of the present invention, other than for the safety platform and safety handbrake as described herein.

The well structure of the rail car bodies are essentially the same between the rail car bodies 10. The well structure includes side walls having a pair of top chord members 12 extending between and attached to the end structures. The top chord members 12 are typically steel tube members that may be, for example, around 14"×6" and around ¼" thick. The well structure side walls include a pair of side sills 14 extending between the end structures. The side sills 14, may be, for example formed of steel 8"×8" angles about ⅝" thick. The well structure side walls include a pair of side sheets 16 extending between the top chord 12 and the side sill 14 as shown. Alternatively the side walls could utilize an open truss configuration that eliminates the side sheets 16 as taught in U.S. Pat. No. 7,954,437, which is incorporated herein by reference. The use of side sheets 16 is a more conventional side wall construction for well cars and is illustrated in FIGS. 4-8.

The well structure includes a pair of end chords extending between the side walls, one at each end of the well structure. The end chords, like the side sills 14, may also be formed of steel angles. The end chords mark the transition between the well structure and the end structures.

The well structure may include four corner container support members, each secured to one end chord and one side sill 14 at four corners of the well structure. The well structure may include a plurality of steel floor beams extending between the side sills 12 forming at least a portion of a floor for the well structure. The well structure may include a pair of center container support members, each secured between the pair of center floor beams and a side sill 14 at a longitudinal center of the well structure. Each center container support member would be positioned to support containers therein, and would be provided to accommodate two 20 foot containers within the well structure.

One key aspect of the present invention is the provision of operator walkway safety platforms at each end of the body 10. Each safety platform includes at least one co-planer end walkway 22 and running boards 20, wherein the running boards 20 are above the top chords 12 of the sidewalls of the well car. One end of the railcar, with handbrake 30 and operating hand wheel 32, has a supplemental end walkway 26 and a co-planar coupling walkway 24 extending from the end walkway 26 to the end walkway 22. The key feature is that for each safety platform the end walkways 22 and 26 (if provided), the runner boards 20, and the coupling walkway 24 are all coplanar so there are no offsets or steps for the operator once they reach the platform. This provides a significant decrease in the tripping hazard for the operators on the platform, allowing the operators to concentrate more on the container placement, removal, securing or the like.

Each safety platform is preferably formed of strong non-skid decking or the like. The self-cleaning open design of decking allows free passage of air, light, and water. For example the GRIP DECK® brand safety grating is a suitable strong, nonskid decking formed of one piece stamped steel construction providing needed strength with minimum weight. Alternatively, the DIAMOND-GRIP® brand Walkway is also a suitable one-piece metal plank grating manufactured by a cold forming process in the shape of an inverted channel with the web of the channel forming the walking surface and including diamond shaped openings. An additional suitable alternative is the Safety-Grip® brand walkway which is a one-piece metal plank grating manufactured by a cold forming process in the shape of a channel. The web of the channel is the walking surface and has large debossed holes, surrounded by smaller embossed traction buttons. An alternative to preformed non-skid decking is the use of material that is treated to be non-skid such as treated with the SLIPNOT® brand process that "transforms ordinary industrial flooring products to extraordinary, durable slip resistant safety products."

The safety platform allows easy safe access to the railcar operators for loading and unloading the intermodal cargo boxes, checking their status and other railcar maintenance and operational jobs. The provision of the end walkway 22, running boards 20, supplemental end walkway 26 (if provided) and coupling walkway 24 (if provided) as coplanar structures reduces the tripping hazards for the operators increasing the safety of the well car.

Access to each safety platform is through ladders 28 on each side aligned with either the end walkway 22 or the supplemental end walkway 26, if provided. Each ladder 28 can be conventional construction. Additionally the rungs on the ladder may also be designed to be slip free such as using SAFETY-TREAD® brand ladder rungs which are small channel shaped sections with the web of the channel being the walking surface which is covered with small perforated dimples, produced by a cold forming process. Conventional rungs can also be treated to be non-slip with a subsequent processing such as the SLIPNOT® brand process.

The well car includes a handbrake 30 operated with a hand wheel 32 mounted on one side of the railroad well car. The construction of the handbrake 30 itself is conventional and known to those in the art. In general the handbrake 30 has a housing securely fastened to the railcar and is of a design that the total braking force of the handbrake 30 is no less that that pressure that is applied to the brake shoes when the brake cylinder is at fifty LBS/in$^2$. The hand wheel 32 is a metal wheel of about 22 inch nominal diameter, which may include a gripping treatment thereto similar to the non slip treatments discussed above.

The safety feature of the present invention is the positioning and access of the handbrake 30 on the side of the current railcar, wherein the hand wheel 32 extends below the top chords 12 of the side walls of the well car as shown whereby the hand wheel 32 is accessible from the side of the railcar via an operator on the ground. The handbrake 30 can thus be operated from an operator on the ground preventing the need for the operator to climb onto the railcar. The handbrake 30 may also be operated by an operator on the railcar if desired.

Although the present invention has been described with particularity herein, the scope of the present invention is not limited to the specific embodiment disclosed. It will be apparent to those of ordinary skill in the art that various modifications may be made to the present invention without departing from the spirit and scope thereof. The scope of the present invention should be defined by the appended claims and equivalents thereto.

What is claimed is:

1. A railroad well car comprising:

A pair of spaced trucks;

A railcar body supported on the trucks, the body comprising a pair of spaced end structures, each end structure supported on one truck, and a well structure extending between the end structures, wherein the well structure including (i) a pair of top chord members extending between the end structures, (ii) a pair of side sills extending between the end structures; and (iii) a floor of the well structure extending generally between the side sills; and operator walkway platforms with co-planer end walkways and running boards, wherein the running boards are above the top chords of the sidewalls of the well car, wherein at least one of the operator platforms includes a pair of spaced co-planar end walkways extending the across a width of the car with one of the co-planar end walkways coupled to a pair of the running boards and a co-planar coupling walkway extending between the pair of spaced co-planar end walkways.

2. The railroad well car according to claim 1 further including a handbrake operated with a hand wheel mounted on one side of the railroad well car.

3. The railroad well car according to claim 2 wherein the hand wheel is positioned beyond an end of one top chord and substantially co-planar with one top chord.

4. The railroad well car according to claim 3 wherein the hand wheel extends vertically below the top chords of the side walls of the well car whereby the hand wheel is accessible from the side of the railcar via an operator on the ground.

5. The railroad well car according to claim 4 wherein the hand wheel is positioned longitudinally between the pair of co-planar end walkways.

6. The railroad well car according to claim 2 wherein the hand wheel is positioned longitudinally between the pair of co-planar end walkways.

7. A railroad well car comprising: A plurality of spaced trucks grouped in pairs;

At least three railcar bodies supported on the trucks, each body comprising a pair of spaced end structures, each end structure supported on one truck, and a well structure extending between the end structures, wherein the well structure include (i) a pair of top chord members extending between the end structures; (ii) a pair of side sills extending between the end structures; (iii) a plurality of floor beams extending between the side sills forming at least a portion of a floor for the well structure; and A handbrake operated with a hand wheel mounted on one side of the railroad well car, which hand wheel is positioned beyond an end of one top chord and substantially co-planar with one top chord and extends vertically below the top chords of the side walls of the well car whereby the hand wheel is accessible from the side of the railcar via an operator on the ground, further including at least one operator walkway platform with a pair of co-planer end walkways and a pair of co-planar running boards, wherein the running boards are above the top chords of the sidewalls of the well car, and further including a central co-planar coupling walkway extending between the pair of spaced co-planar end walkways.

8. The railroad well car according to claim 7, wherein the hand wheel is mounted longitudinally between the pair of co-planar end walkways.

9. A railroad double stack container well car comprising:

A plurality of spaced trucks;

At least one railcar body supported on a pair of the trucks, each body comprising a pair of spaced end structures, each end structure supported on one truck, and a well structure extending between the end structures, wherein the well structure includes (i) A pair of top chord members extending between the end structures; and (ii) a pair of side sills extending between the end structures; and (iii) a pair of end chords extending between the side sills, one at each end of the well structure;

At least one operator walkway platforms with a pair of co-planer end walkways and a pair of co-planar running boards, wherein the running boards are above the top chords of the sidewalls of the well car; and A handbrake operated with a hand wheel mounted on one side of the railroad well car positioned longitudinally between the pair of co-planar end walkways, which hand wheel extends below the top chords of the side walls of the well car whereby the hand wheel is accessible from the side of the railcar via an operator on the ground, further including a central co-planar coupling walkway extending between the pair of spaced co-planar end walkways.

10. The railroad well car according to claim 9, wherein the hand wheel mounted on one side of the railroad well car is positioned beyond an end of one top chord and substantially co-planar with one top chord.

* * * * *